US011047058B2

(12) United States Patent
Li et al.

(10) Patent No.: US 11,047,058 B2
(45) Date of Patent: Jun. 29, 2021

(54) METHOD FOR MANUFACTURING LEADING EDGE GUARD

(71) Applicant: GENERAL ELECTRIC COMPANY, Schenectady, NY (US)

(72) Inventors: Qiang Li, Cincinnati, OH (US); Nicholas Joseph Kray, West Chester, OH (US); Michael W. Peretti, Newark, DE (US); Tod Winton Davis, Cincinnati, OH (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 595 days.

(21) Appl. No.: 15/304,682

(22) PCT Filed: Apr. 2, 2015

(86) PCT No.: PCT/US2015/024043

§ 371 (c)(1),
(2) Date: Oct. 17, 2016

(87) PCT Pub. No.: WO2015/160527

PCT Pub. Date: Oct. 22, 2015

(65) Prior Publication Data

US 2017/0044681 A1 Feb. 16, 2017

Related U.S. Application Data

(60) Provisional application No. 61/980,998, filed on Apr. 17, 2014.

(51) Int. Cl.
*C25D 1/02* (2006.01)
*C25D 1/00* (2006.01)
(Continued)

(52) U.S. Cl.
CPC ..... *C25D 1/02* (2013.01); *C25D 1/00* (2013.01); *F04D 29/325* (2013.01); *F04D 29/388* (2013.01)

(58) Field of Classification Search
CPC ..... C25D 1/02; C25D 1/00; F04D 29/388; F04D 29/325
See application file for complete search history.

(56) References Cited

U.S. PATENT DOCUMENTS 5,063,662 A * 11/1991 Porter ..... B21D 11/14 148/671
5,674,370 A * 10/1997 DuPree ..... C25D 1/00 205/114

(Continued)

FOREIGN PATENT DOCUMENTS

EP 0 448 339 A1 9/1991
EP 0863072 A2 9/1998
EP 2540874 A2 1/2013

OTHER PUBLICATIONS

PCT Search Report and Written Opinion issued in connection with corresponding PCT Application No. PCT/US2015/024043 dated Jul. 9, 2015.

(Continued)

*Primary Examiner* — Louis J Rufo
(74) *Attorney, Agent, or Firm* — Dority & Manning, P.A.

(57) ABSTRACT

A method for making a metallic leading edge guard of the type having a nose with first and second wings extending therefrom is disclosed. The method includes machining from a metallic blank a first half comprising a first portion of the nose and one of the wings, wherein the first portion of the nose includes an interface surface; and electroforming a second half comprising a second portion of the nose and the second wing, wherein the second half is joined to the first half at the interface surface.

10 Claims, 6 Drawing Sheets

(51) Int. Cl.
*F04D 29/32* (2006.01)
*F04D 29/38* (2006.01)

(56) References Cited

U.S. PATENT DOCUMENTS

| | | | | |
|---|---|---|---|---|
| 5,908,285 | A | 6/1999 | Graff | |
| 5,976,340 | A | 11/1999 | Sheldon et al. | |
| 8,088,498 | B2 | 1/2012 | Smith et al. | |
| 2012/0301292 | A1* | 11/2012 | Deal ..... | F01D 5/147<br>415/220 |

OTHER PUBLICATIONS

Electroforming, Wikipedia article, last modified Jul. 27, 2016, retrieved from "https://en.wikipedia.org/wiki/Electroforming" on Sep. 23, 2016.
Machine Translation and First Office Action and Search issued in connection with corresponding CN Application No. 201580020132.3 dated Jun. 4, 2018.

* cited by examiner

METHOD FOR MANUFACTURING LEADING EDGE GUARD

BACKGROUND

Embodiments of the present invention relate generally to fan blade protective leading edges and in particular to methods for manufacturing such leading edges.

Fan blades used in jet engine applications are susceptible to foreign object impact damage such as bird ingestion events. Blades made of graphite fiber reinforced composite material are attractive due to their high overall specific strength and stiffness. However, graphite composites are particularly prone to brittle fracture and delamination during foreign object impacts due to their low ductility. Blade leading edges, trailing edges, and tips are particularly sensitive because of the generally lower thickness in these areas and the well-known susceptibility of laminated composites to free edge delamination. In addition blade geometry and high rotational speeds relative to aircraft speeds cause ingested objects to strike the blade near the leading edge.

Metallic guards bonded to the leading edges of composite fan blades are known to provide impact damage protection. However, newer fan blade designs require that such guards be both thin and made of high-density alloys. These requirements make manufacture of leading edge guards difficult with known methods such as conventional machining or hot creep forming.

It has been proposed to form metal leading edge guards using an electroforming process. However, the proposed methods require either that excess material remain after the electroforming process, or that a complex process be used with multiple sets of tooling.

Accordingly, there remains a need for an efficient method of producing fan blade metallic leading edge guards.

BRIEF DESCRIPTION

This need is addressed by embodiments of the present invention, which provide a method for manufacturing metal leading edge guards using a combination of electroforming and conventional machining.

According to one aspect of the invention, a method is provided for making a metallic leading edge guard of the type having a nose with first and second wings extending therefrom. The method includes: machining from a metallic blank a first half comprising a first portion of the nose and one of the wings, wherein the first portion of the nose includes an interface surface; and electroforming a second half comprising a second portion of the nose and the second wing, wherein the second half is joined to the first half at the interface surface.

According to another aspect of the invention, the leading edge guard includes an interior surface collectively defined by the nose and the wings, and a portion of the interior surface defined by the first half is machined to final dimensions before the electroforming step.

According to another aspect of the invention, the first half is mounted to an electrically-conductive mandrel for the electroforming step.

According to another aspect of the invention, the leading edge guard includes an exterior surface collectively defined by the nose and the wings, and wherein, during the electroforming step, a fixture is mounted over a portion of the exterior surface that is defined by the first half.

According to another aspect of the invention, the interface surface is disposed such that a maximum thickness of metal to be deposited in the electroforming step is less than an axial length of the nose.

According to another aspect of the invention, the interface surface is disposed such that the first and second portions of the nose are of substantially equal thickness.

According to another aspect of the invention, the interface surface is disposed such that second portion of the nose is significantly thinner than the first portion of the nose.

According to another aspect of the invention, the exterior surface is machined to final dimensions subsequent to the electroforming step.

According to another aspect of the invention, the first and second halves are made of a nickel-based alloy.

BRIEF DESCRIPTION OF THE DRAWINGS

Embodiments of the present invention may be best understood by reference to the following description taken in conjunction with the accompanying drawing figures in which.

DETAILED DESCRIPTION

Figure 1:
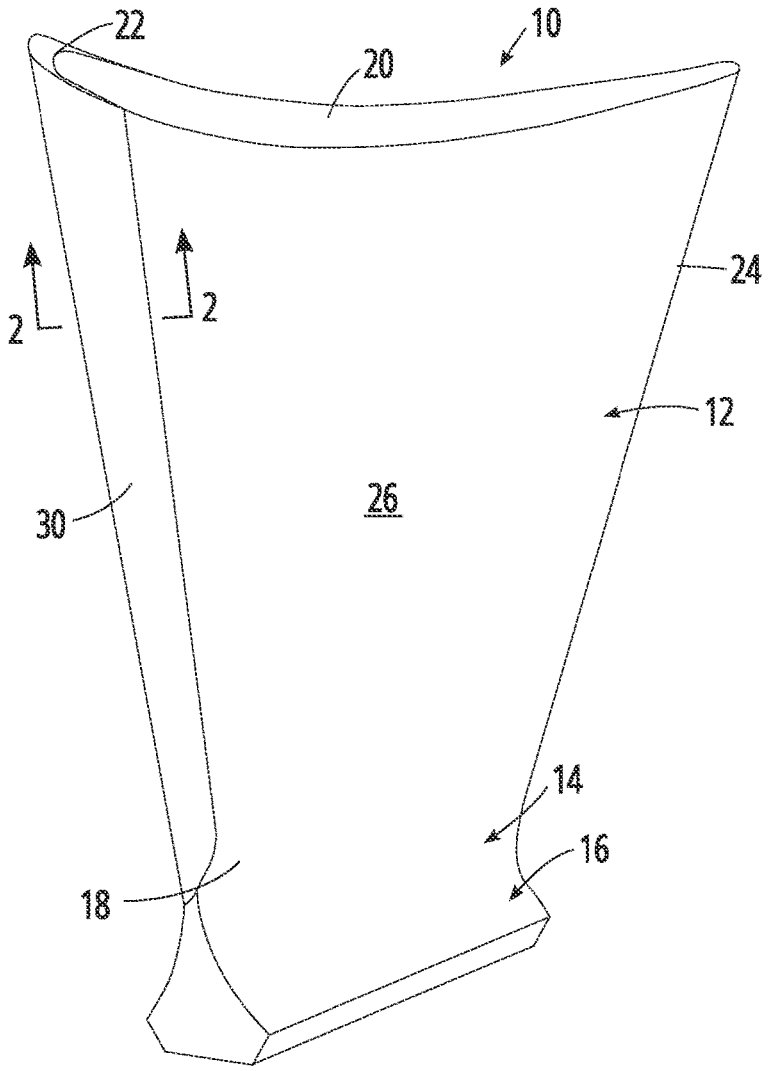
FIG. 1 is a view of a gas turbine engine fan blade incorporating a leading edge strip constructed in accordance with an aspect of the present invention.
Figure 2:
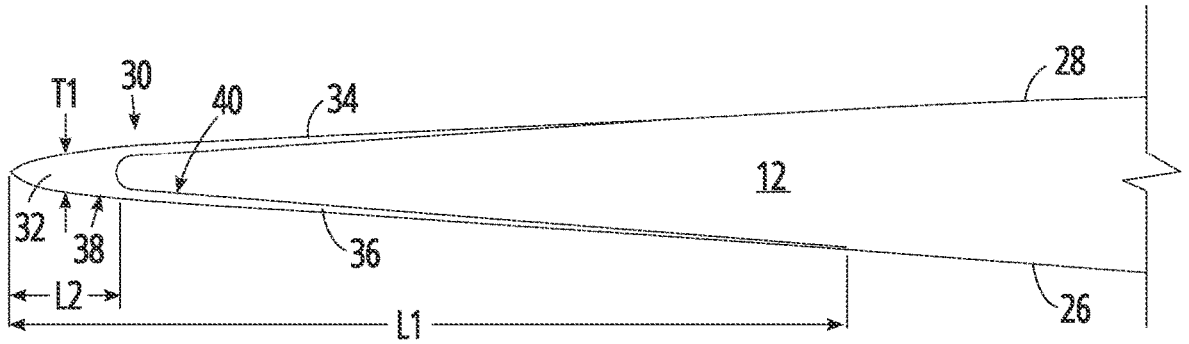
FIG. 2 is a cross-sectional view of a portion of the fan blade of FIG. 1.

Referring to the drawings wherein identical reference numerals denote the same elements throughout the various views, FIG. 1 depicts an exemplary fan blade 10 for a gas turbine engine. The fan blade 10 includes an airfoil 12, shank 14, and dovetail 16. The airfoil 12 extends between a root 18 and a tip 20, and has a leading edge 22 and a trailing edge 24. Opposed convex and concave sides 26 and 28, respectively, extend between the leading edge 22 and the trailing edge 24.

The fan blade 10 may be made from a known nonmetallic material, such as a carbon fiber-epoxy composite system.

The fan blade has a metallic leading edge guard 30 attached to the leading edge 16. The leading edge guard 30 helps provide the fan blade 10 with additional impact resistance, erosion resistance and improved resistance of the composite structure to delamination.

The leading edge guard 30 includes a nose 32 with a pair of wings 34 and 36 extending aft therefrom. The wings 34 and 36 taper in thickness as they extend away from the nose 32. Exterior surfaces of the nose 32 and wings 34 and 36 collectively define an exterior surface 38 of the leading edge guard 30. The shape and dimensions of the exterior surface 38 are selected to act as an aerodynamic extension of the airfoil 12. The leading edge guard 30 may be attached to the airfoil 12 with a known type of adhesive.

Interior surfaces of the nose 32 and wings 34 and 36 collectively define an interior surface 40 of the leading edge guard 30. The shape and dimensions of the interior surface 38 are selected to closely fit the exterior of the airfoil 12.

The leading edge guard 30 has an overall length "L1" measured in an axial direction. The nose 32 has an axial length designated "L2," and a thickness "T1" measured perpendicular to the lengths. All of these dimensions will vary to suit a particular application; however in general, the length L1 is about 3 to 6 times the length L2. The length "L2" is typically significantly larger that can be achieved with known electroforming processes. For example it may be about 3.8 cm (1.5 in) to about 10.2 cm (2.0 in).

Embodiments of the present invention provide a method for making the leading edge guard 30. The process is explained with reference to the block diagram shown in FIG. 3. The leading edge guard 30 is an integral or unitary component formed from two major parts, herein referred to as a "first half" and a "second half." The term "half" is used merely for reference and does not necessarily imply that the two components are equal in terms of size, shape, volume, or mass. In a first step (block 100), the first half 42 is machined from a blank of material (shown schematically in dashed lines in FIG. 4) using conventional machinery and processes, such as milling operations. The portion of the interior surface 40 defined by the first half 42 is machined to its final dimensions using one or more conventional processes. The portion of the exterior surface 38 defined by the first half 42 is rough machined, that is, close to the required net shape.

Figure 4:
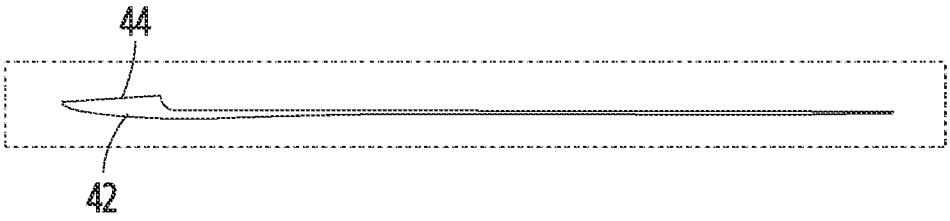
FIG. 4 is a cross-sectional view of a first half of a leading edge guard being formed.
Figure 5:
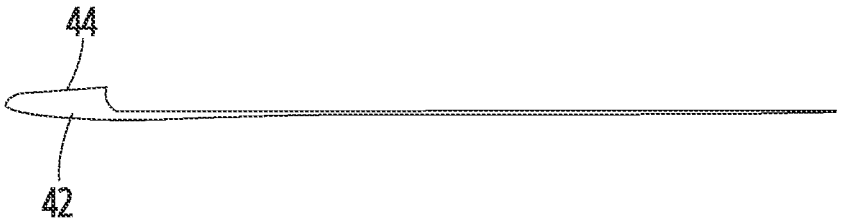
FIG. 5 is a cross-sectional view of an alternative first half configuration.

The first half 42 includes a planar interface surface 44 which extends in a generally axial direction through the nose 32. The location of the interface surface 44 can be selected to provide the best balance of process and product characteristics. In the example shown in FIG. 4, the interface surface 44 approximately cuts the nose 32 in two equal parts, providing the largest area for the interface surface 44. In the example shown in FIG. 5, the interface surface 44 is offset away from the center position. This reduces the amount of electroform buildup required, as described in more detail below.

In a second step (block 200 of FIG. 3), the first half 42 is mounted onto a mandrel 46. The mandrel 46 (FIG. 6) is made from or coated with an electrically conductive material. It has a surface 48 that closely matches the interior surface 40 of the leading edge guard 30. A fixture 50 with a surface 51 closely matching the portion of the exterior surface 38 defined by the first half 42 is placed against the first half 42. This serves to physically locate the first half 42 and to mask it from electroforming buildup.

The fixtured first half 42 is placed in an electroforming apparatus 52 comprising a tank 54, an electrolytic solution 56, and a source electrode 58. The source electrode 58 and the mandrel 46 are connected in an electric circuit with a suitable electric power supply, shown schematically at 60.

The source electrode 58 is made from a metal alloy of the desired composition. A non-limiting example of an alloy suitable for construction of the electrode 58 (and also of the first half 42) is a nickel-based alloy commercially available as INCONEL 718 or IN718.

Figure 6:
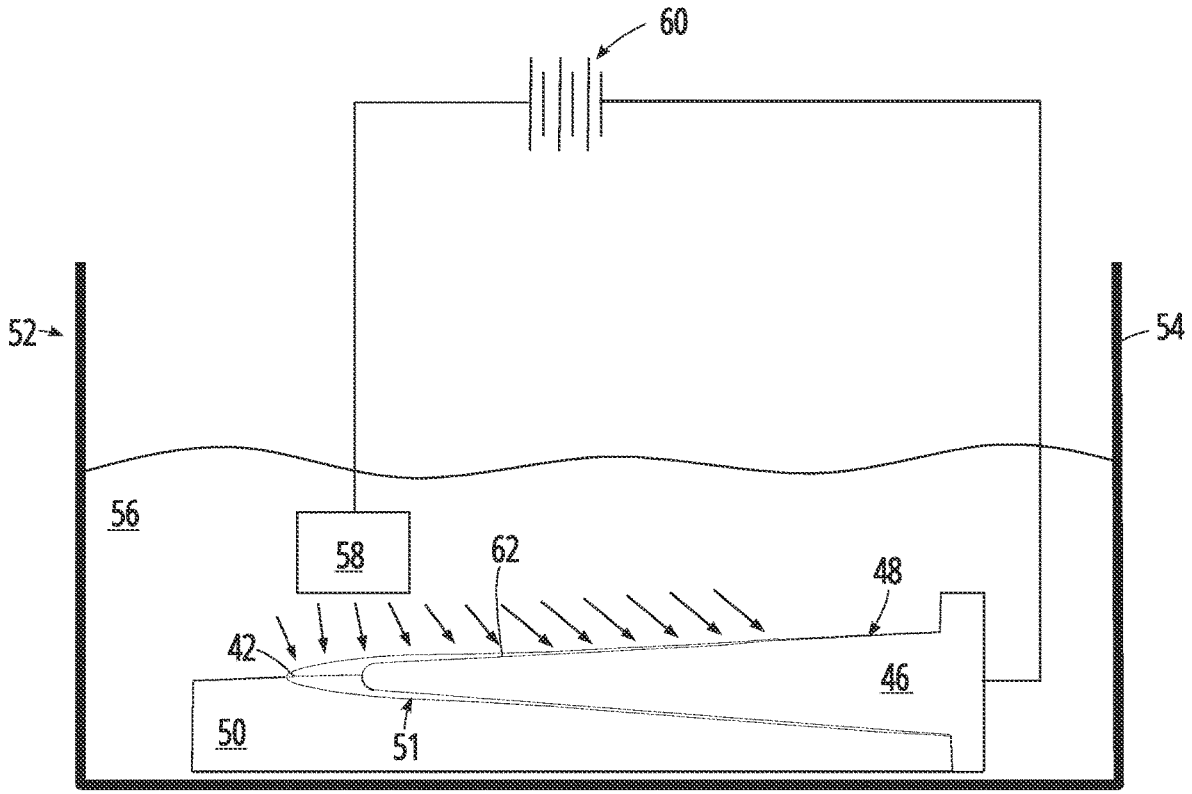
FIG. 6 is a cross-sectional view of a second half of a leading edge guard being formed.

When the circuit is closed, material is transferred from the electrode 58 through the electrolytic solution 56 and deposited on the interface surface 44 of the first half 42 as well as the mandrel 46, effectively building up a second half 62 in rough form, as depicted by the arrows in FIG. 6. Once a suitable thickness has formed, the circuit is opened and the mandrel 46 with leading edge guard 30 attached is removed from the electroforming apparatus 52.

During the electroforming process, the maximum thickness of material to be built up occurs in the nose 32. This is designated as "T2." In an embodiment of the present invention, T2 is much less than L2, which would otherwise represent the maximum required thickness buildup. For example, T2 may be less than half of L2. In many cases, the dimension L2 is greater than practically possible with known electroforming processes, and the present invention permits the use of electroforming where it would otherwise be unusable. As noted above, the position of the interface surface 44 may be selected so that T2 is a desired dimension.

Figure 7:
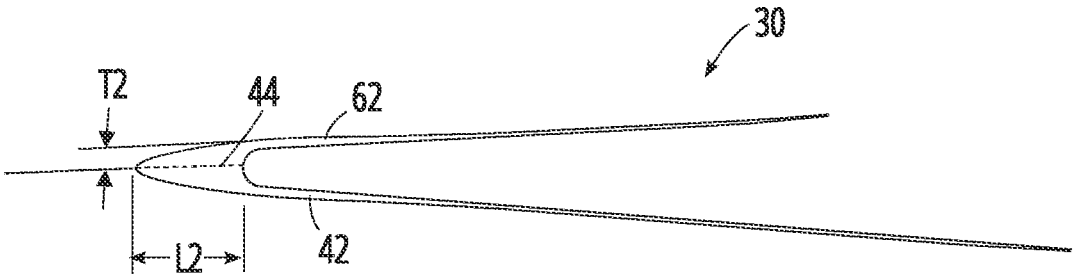
FIG. 7 is a cross-sectional view of a leading edge guard.
Figure 8:
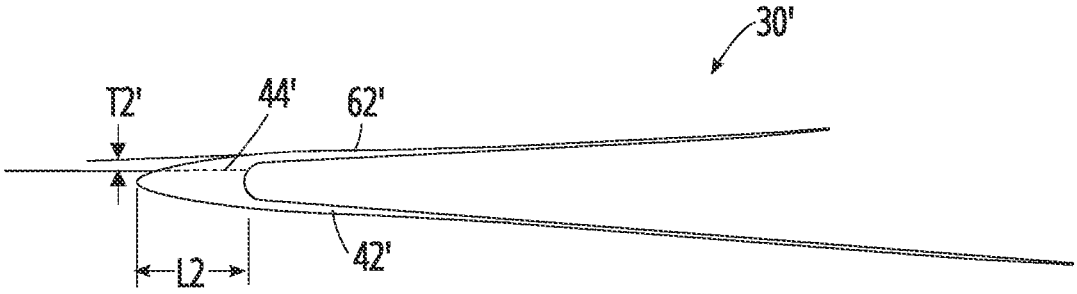
FIG. 8 is a cross-sectional view of a second leading edge guard.

For example, FIG. 7 illustrates a completed leading edge guard 30 with two halves 42 and 62 joined at an interface surface 44. The distance T2 divides the nose 32 approximately in half. In contrast, FIG. 8 illustrates a completed leading edge guard 30' with two halves 42' and 62' joined at an interface surface 44'. The distance T2' is significantly smaller than then distance T2 shown in FIG. 7.

Figure 3:
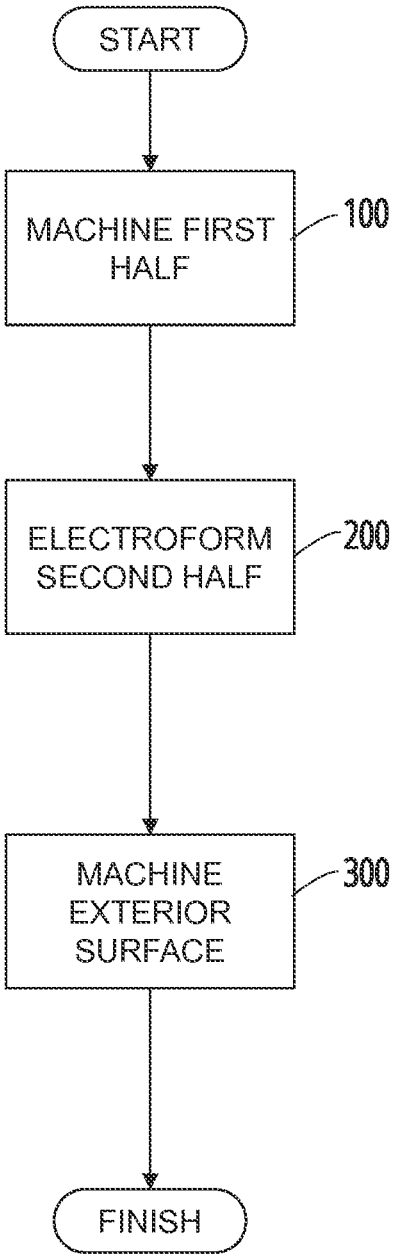
FIG. 3 is a block diagram showing the method steps according to an embodiment of the present invention.
Figure 9:
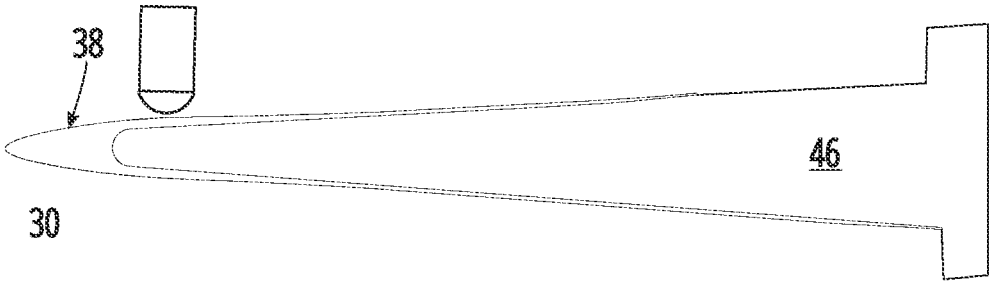
FIG. 9 is a cross-sectional view of a leading edge guard during a final machining process.

Referring to block 300 of FIG. 3, the exterior surface 38 of the leading edge guard 30 may be machined to its final dimensions using conventional machining processes and apparatus, such as the illustrated milling cutter (FIG. 9). The mandrel 46 may be used as a fixture to hold the leading edge guard 30 during the final machining process. Alternatively, the mandrel 46 could be removed and a similar fixture used to hold the leading edge guard 30 during final machining.

The completed leading edge guard 30 can be attached to an airfoil 12 in a conventional manner. The process described herein may have several benefits over prior art methods. By preforming the first half 42, the thickness that needs to build up with electroforming is reduced, making electroforming a viable process for the leading edge guard 30. The same alloy is electroformed on both sides of the interface surface 44, and material strength is not degraded at the interface surface 44. Furthermore, there is no limitation or restriction on the internal corner radii of the interior surface 40.

The foregoing has described a method for making a metallic leading edge guard. All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

It is to be understood that even though numerous characteristics and advantages of various embodiments have been set forth in the foregoing description, together with details of the structure and functions of various embodiments, this disclosure is illustrative only, and changes may be made in detail, especially in matters of structure and arrangement of parts within the principles of the embodiments to the full extent indicated by the broad general meaning of the terms in which the appended claims are expressed. It will be appreciated by those skilled in the art that the teachings disclosed herein can be applied to other systems without departing from the scope and spirit of the application.

What is claimed is:

1. A method for making a metallic leading edge guard of the type having a nose with first and second wings extending therefrom, the method comprising:

using a machining device to remove material from a metallic blank to create a first half of the metallic leading edge guard, the first half including a first portion of the nose and the first wing, wherein the first portion of the nose includes an interface surface; and electroforming a second half of the leading edge guard comprising a second portion of the nose and the second wing, wherein the second half is joined to the first half at the interface surface.

2. The method of claim 1, wherein the leading edge guard includes an interior surface collectively defined by the nose and the wings, and a portion of the interior surface defined by the first half is machined to final dimensions before the electroforming step.

3. The method of claim 1, wherein the first half is mounted to an electrically-conductive mandrel for the electroforming step.

4. The method of claim 1, wherein the leading edge guard includes an exterior surface collectively defined by the nose and the wings, and wherein, during the electroforming step, a fixture is mounted over a portion of the exterior surface that is defined by the first half.

5. The method of claim 1, wherein the interface surface is disposed such that a maximum thickness of metal to be deposited in the electroforming step is less than an axial length of the nose.

6. The method of claim 1, wherein the interface surface is disposed such that the first and second portions of the nose are of substantially equal thickness.

7. The method of claim 1, wherein the interface surface is disposed such that second portion of the nose is thinner than the first portion of the nose.

8. The method of claim 1, wherein the exterior surface is machined to final dimensions subsequent to the electroforming step.

9. The method of claim 1, wherein the first and second halves comprise a nickel-based alloy.

10. The method of claim 1, wherein an overall axial length of the leading edge guard is about 3 to 6 times an axial length of the nose.

* * * * *